US005341116A

United States Patent [19]

Kerkhoff et al.

[11] Patent Number: 5,341,116

[45] Date of Patent: Aug. 23, 1994

[54] RF EXPANSION JOINT

[75] Inventors: William A. Kerkhoff; Rex L. Niekamp, both of Quincy, Ill.

[73] Assignee: Harris Corporation, Melbourne, Fla.

[21] Appl. No.: 997,700

[22] Filed: Dec. 28, 1992

[51] Int. Cl.[5] ..... H01P 1/04

[52] U.S. Cl. ..... 333/260; 174/88 C; 439/33; 439/578

[58] Field of Search ..... 333/24 C, 243, 244, 333/260; 439/32, 33, 578; 174/84 R, 85, 88 C

[56] References Cited

U.S. PATENT DOCUMENTS

| | | | |
|---|---|---|---|
| 3,054,981 | 9/1962 | Malek et al. | 333/260 X |
| 3,245,027 | 4/1966 | Ziegler, Jr. . | |
| 3,292,117 | 12/1966 | Bryant et al. | 333/260 |
| 3,309,632 | 3/1967 | Trudeau | 333/260 X |
| 3,568,111 | 3/1971 | Dyer et al. | 333/260 |
| 4,543,548 | 9/1985 | Seal et al. | 333/243 |
| 5,120,705 | 6/1992 | Davidson et al. | 333/24 C X |

*Primary Examiner*—Paul Gensler
*Attorney, Agent, or Firm*—Tarolli, Sundheim & Covell

[57] ABSTRACT

An RF expansion joint is presented herein for connecting first and second axially spaced tubular conductor sections, having opposed free ends, together as the sections expand and contract with temperature variations and for providing passage of RF energy at a desired operating frequency between the sections. The joint includes an insulator sleeve which is received by the first section with the sleeve having a passageway extending longitudinally therethrough. An electrically conductive stub having proximal and distal ends is mounted to the free end of the second conductor section and extends into the passageway of the sleeve so as to be slidably received thereby. The distal end of the stub extends beyond the sleeve sufficient that the distal end is spaced inwardly from the inner wall of the first conductor section presenting essentially an open circuit to passage of RF energy.

6 Claims, 2 Drawing Sheets

RF EXPANSION JOINT

BACKGROUND AND FIELD OF THE INVENTION

This invention relates to the art of RF transmission employed in RF broadcast transmitting systems and, more particularly, to providing a radio frequency (RF) expansion joint for electrically coupling a pair of axially spaced conductor sections together as the sections axially expand and contract due to temperature variations.

The invention is particularly described in conjunction with providing an expansion joint for adjacent sections of an inner conductor of a coaxial transmitting antenna. It is to be appreciated, however, that the invention may also be employed for use with coaxial transmission lines of the type employed in a broadcast antenna feed system.

An RF transmission system includes a relatively small diameter inner conductor, which may be made of copper, and which is telescoped into a substantially larger diameter outer conductor, which may be made of copper, aluminum or steel. Whether the inner and outer conductors are of the same or different materials, it is apparent that when high power is applied the relatively small diameter inner conductor will thermally expand and contract in an axial direction to a greater degree than that of the outer conductor. It is desirable to compensate for the differential expansion between the inner and outer conductors in such an RF transmission system.

It has been common in the prior art to employ a watch band spring expansion joint to connect adjacent coaxially spaced sections of the inner conductor. Such a watch band spring joint typically includes a bullet member mounted to one of the conductor sections and a watch band spring device mounted to the other conductor section to provide a telescopic sliding fit therebetween to permit relative expansion and contraction. However, repeated sliding of the components against one another results in severe mechanical wear. It is known that such -watch band spring connections are rather fragile and prone to problems that may arise from improper manufacture, improper assembly and excessive wear. An example of such a watch band spring joint takes the form of that disclosed in the U.S. Pat. No. to G. W. Ziegler, Jr. 3,245,027.

Another prior art device takes the form of that disclosed in the U.S. Pat. No. to W. W. Seal et al. 4,543,548. That patent discloses an expandable and contractible bellows made of conductive material which is connected between opposing ends of adjacent inner conductor sections. The bellows surrounds a mechanical supporting structure including an elongated tube having an end fixed to one of the conductor sections. The opposite end of the tube is slidably received within a sleeve which is connected to the other conductor section. This tube and sleeve construction provides mechanical support for the bellows to prevent the bellows from being overstressed in tension, compression and/or torsion during use. However, such a bellows will, with use over tee, result in metal fatigue causing tiny breaks in the bellows which may result in arcing and burn out.

SUMMARY OF THE INVENTION

It is an object of the present invention to provide an expansion joint to accommodate axial expansion and contraction between a pair of inner conductor sections without employing watch band spring joints or bellows structures from the prior art.

In accordance with the present invention, there is provided an RF expansion joint for electrically coupling first and second axially spaced conductor sections, having opposing free ends, together as the conductor sections axially expand and contract due to temperature variations while providing passage of RF energy at a desired operating frequency between the sections. The joint employs an elongated insulated sleeve constructed of dielectric material and adapted throughout most of its length to be received by the first section. The sleeve has a passageway which extends longitudinally therethrough and which is coaxial with the first and second conductor sections. electrically conductive elongated stub is provided having proximal and distal ends. The proximal end of the stub is mounted to the free end of the second section and the distal end extends toward the free end of the first section. The stub is longer than that of the passageway and is slidably received such that the distal end of the stub extends through and beyond the sleeve sufficient that the distal end thereof is spaced inwardly from the inner wall of the first section presenting essentially an open circuit to the passage of RF energy.

BRIEF DESCRIPTION OF THE DRAWINGS

The foregoing and other objects and advantages of the invention will become readily apparent from the following description of a preferred embodiment, as taken in conjunction with the accompanying drawings which are a part hereof, and wherein.

DESCRIPTION OF PREFERRED EMBODIMENTS

Reference is now made to the drawings, wherein the showings are for purposes of illustrating preferred embodiments of the invention and not for purposes of limiting same.

Figure 1:
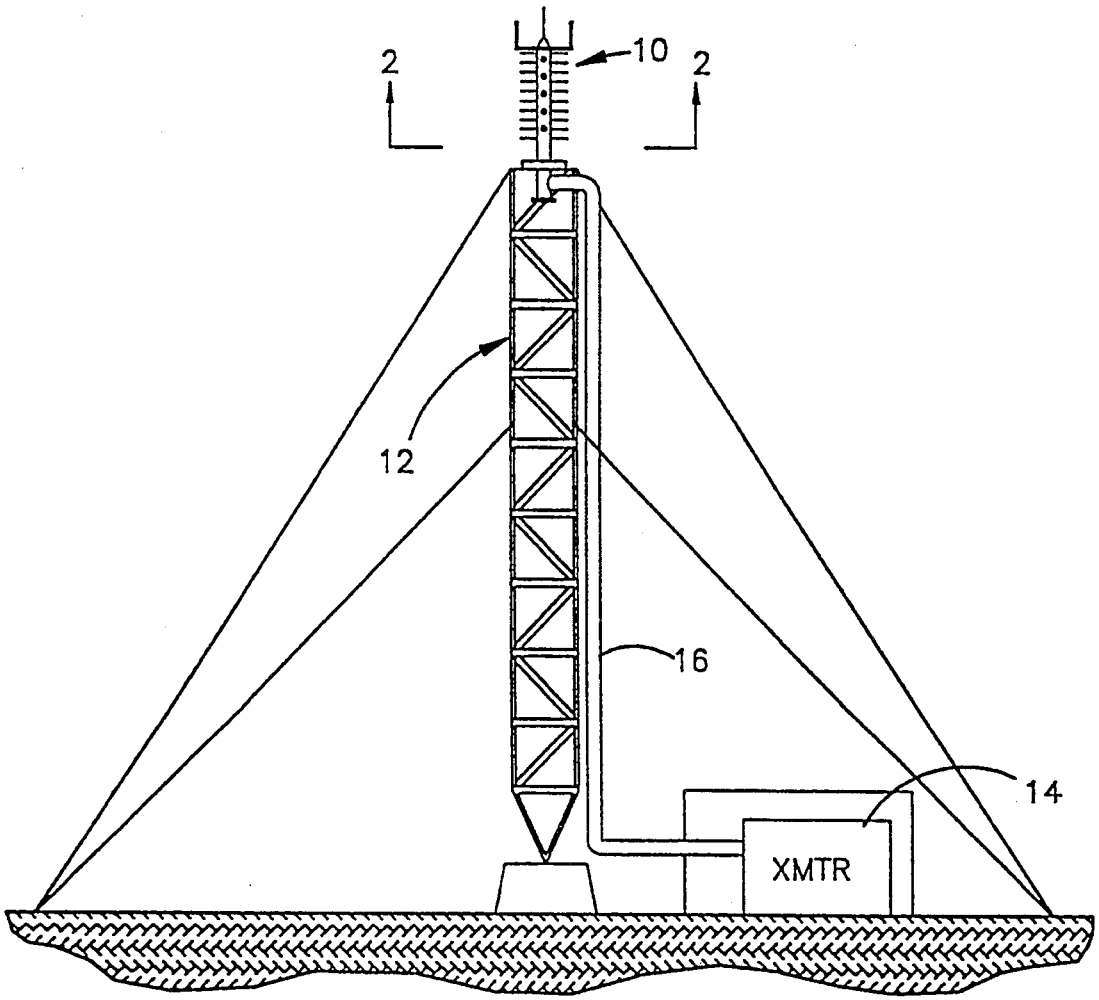
FIG. 1 is a schematic elevational illustration of an antenna system incorporating the invention.

In FIG. 1, there is illustrated an elevational view of a UHF antenna 10 mounted on top of a tower structure 12 of conventional design. The tower height may, for example, be on the order of 1,000 feet and the height of the UHF antenna 10 may be on the order of 50 feet. At ground elevation, there is schematically illustrated an RF transmitter 14 which is supplying RF energy to a transmission feed system 16 and which, in turn, is supplying RF energy to the antenna 10. The transmission feed system 16 may include, for example, a rigid coaxial feed line including a horizontal portion and a vertical portion which extends up along one side of the tower structure 12 to feed the antenna 10 in a conventional manner.

Figure 2:
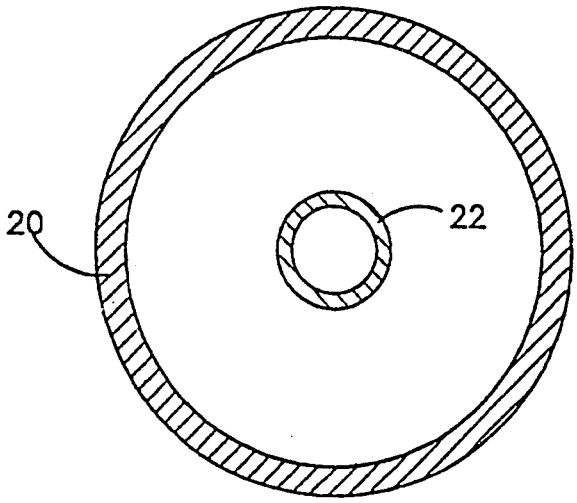
FIG. 2 is a cross sectional view illustrating the construction of a section of the antenna employed herein.

The antenna 10, in the example being presented, is a coaxial transmitting antenna including an outer conductor 20 and a coaxially disposed inner conductor 22, as seen in FIG. 2. The outer conductor 20 may have an outside diameter on the order of six inches whereas the inner conductor 22 may have an outside diameter on the order of 2.6 inches. The inner and outer conductors may be held in spaced relationship from each other by axially spaced radially extending insulating devices, such as radially extending dielectric pins (not shown).

The inner conductor 22 has a diameter which is substantially less than that of the outer conductor. During operation, the inner conductor becomes hotter than the outer conductor. That is, current flows along the surface of the conductor. Since the inner conductor has less surface area it gets hotter than the outer conductor, even if both the inner conductor and the outer conductor are constructed of the same material, such as copper. This is compounded by the fact that sometimes the outer conductor is constructed of steel or aluminum, whereas the inner conductor is constructed of copper. Consequently, the inner conductor thermally expands and contracts in an axial direction to a greater degree than that of the outer conductor. The inner conductor is formed by axially spaced sections and, in accordance with the present invention, the sections are connected together with an expansion joint.

Figure 3:
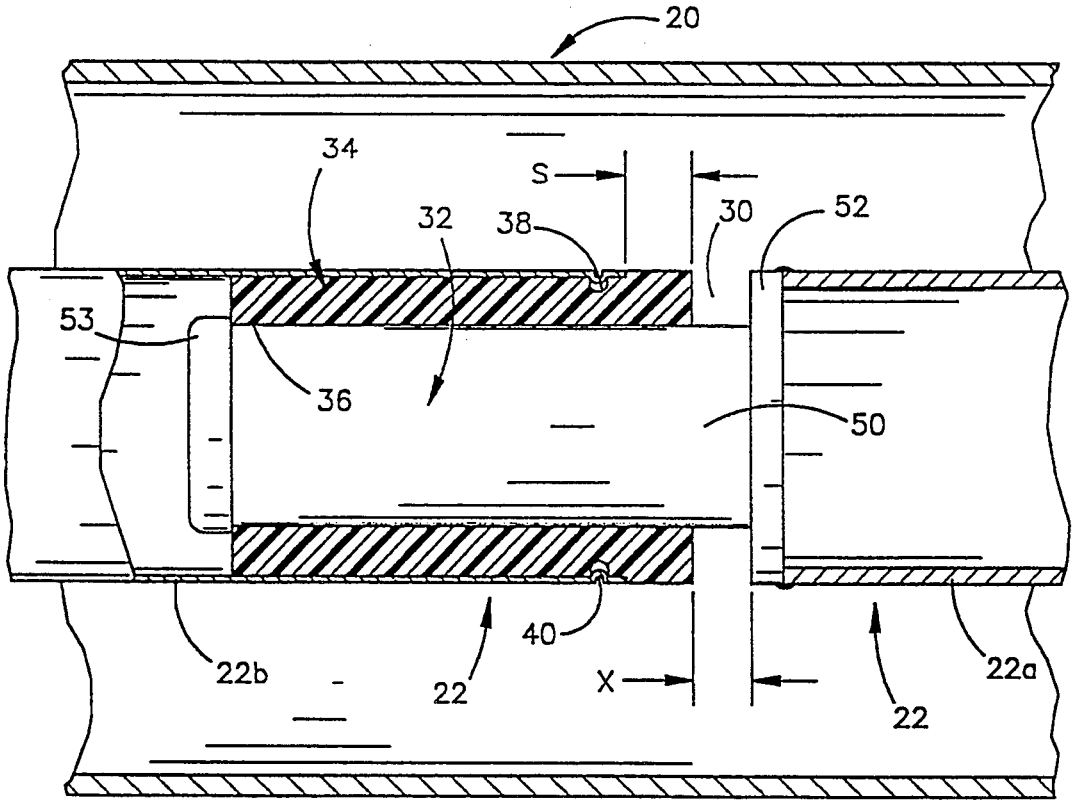
FIG. 3 is an enlarged cross sectional view illustrating one embodiment of the expansion joint in accordance with the present invention; and, FIG. 4 is a view similar to that of FIG. 3 but showing a second embodiment of the expansion joint of the present invention.

Reference is now made to FIG. 3 which illustrates an inner conductor 22 as including axially spaced sections *22a* and *22b*. These sections are interconnected with an expansion joint 30 constructed in accordance with one embodiment of the present invention. The expansion joint 30 includes an electrically conductive elongated stub 32 having proximal and distal ends. The proximal end is mechanically and electrically connected to the inner conductor section *22a*. The expansion joint also includes a dielectric insulator sleeve 34 which is received within the lumen of conductor section *22b* so that the sleeve 34 extends throughout most of its length within the conductor section *22b*. A portion of the length of the sleeve 34 extends for a distance S beyond the free end of conductor section *22b*. The sleeve 34 has a passageway 36 which is circular in cross section and which extends longitudinally through the sleeve with its passageway being coaxial with the conductor sections *22a* and *22b*. The sleeve 34 is provided with an annular groove 38 near the free end of conductor section *22b* and this groove serves to receive an annular necked-in portion 40 of the conductor section *22b*. This assists in keeping the sleeve 34 properly positioned within the conductor section *22b* so that an exposed portion of the sleeve 34 extends for a distance S beyond the free end of the conductor section *22b*. The sleeve 34 is an insulator constructed of dielectric material, preferably Teflon.

The stub 32 may be constructed of copper or brass and includes an elongated rod 50 which may, in the example presented herein, be of a diameter on the order of 1.711 inches so that it is slidably received within the passageway 36 of the sleeve 34. At its proximal end, the rod 50 has a radially extending flange or shoulder 52 of a diameter corresponding with the outer diameter of the conductor section *22a* and, as described herein before, this may be on the order of 2.6 inches. The shoulder 52 is mechanically and electrically secured to the conductor section *22a*, as with a suitable bond such as solder. In the position as shown in FIG. 3 the shoulder 52 is spaced from the sleeve 34 by a distance X and this may be on the order of ⅜th of an inch. At its distal end, the stub 32 is provided with an enlarged radially extending flange 53 which may take the form of a bushing. The bushing may be suitably fastened to the distal end of the rod 50, as by soldering. This fastening takes place after the rod 50 has been inserted in place so that it extends through the passageway 36. The flange 53 acts as a stop to prevent the gap between shoulder 52 and sleeve 34 from exceeding the distance X discussed hereinabove. This distance X serves as a limit to the axial movement between conductor sections *22a* and *22b*.

When the stub 32 extends all the way into sleeve 34 so that the distance X is reduced to zero, there will still be a gap between the conductive shoulder 52 and the conductor section *22b*. This gap has an axial distance S. This helps to prevent arcing between the two conductor sections *22a* and *22b* as one moves relative to the other.

The impedance between the outer surface of stub 32 and the conductor section *22b* increases from the proximal end to the distal end of the stub. The impedance at the distal end at flange 53 is essentially an open circuit to RF energy between the flange and the inner surface of conductor *22b*. However, the length of the stub between its distal and proximal ends is essentially one-quarter wavelength at the operating frequency resulting in essentially a short circuit to RF energy between the free ends of conductor sections *22a* and *22b*. A relative movement of up to 0.5 inches produces a VSWR that may vary from 1.02 to 1.08 during expansion. This small change in VSWR is considered negligible. Measured data indicates that bandwidths of up to 10% are realizable for expansions on the order of 0.5 inches. Movement of the stub inside the sleeve 34 is limited by the enlarged diameter of the flange 53 at the distal end of the stub. This large diameter flange 53 also ties the two sections of the conductor 22 together.

The diameters of the inner conductor sections *22a* and *22b* are not critical. Nearly any diameter tubing can be employed for the inner conductors, The tubing sizes selected for an application depend on the characteristic impedance of the coaxial cable employed, The characteristic impedance of the coaxial section forming the joint is kept low to minimize the possibility of arcing. The dimensions discussed hereinabove produce an impedance on the order of approximately 16 ohms.

Figure 4:
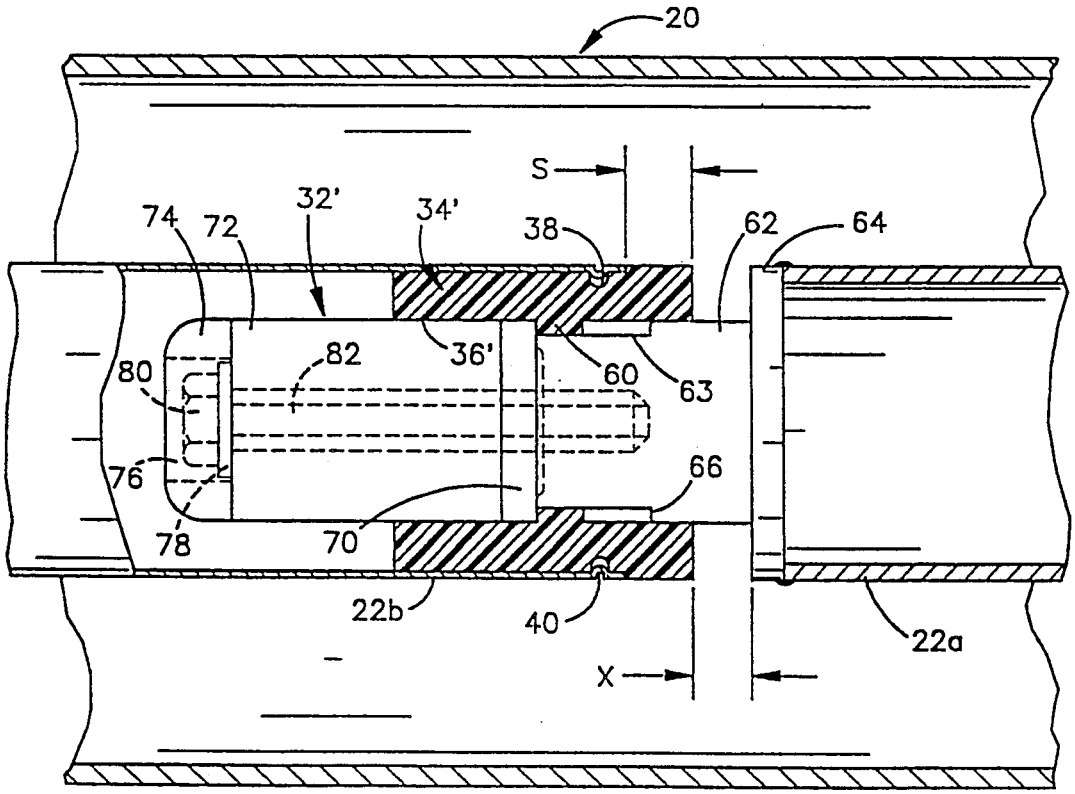

Reference is now made to FIG. 4 which illustrates another embodiment of the expansion joint. Like components in both of the embodiments of FIGS. 3 and 4 are identified by like character references, In this embodiment, the insulator sleeve 34' is somewhat shorter than that of insulator sleeve 34 of FIG. 3 and the stub 32' is substantially longer than that of the sleeve 34'. As in the first embodiment, the stub 32' has a total length on the order of one-quarter wavelength at the operating frequency. The expansion joint serves to interconnect inner conductor sections *22a* and *22b*. This is achieved with stub 32' which is connected at its proximal end to section *22a* and which extends through a passageway 36' located in the sleeve 34' mounted within the conductor section *22b*. The sleeve 34' has a radially inwardly extending portion 60 which, as will be described in greater detail hereinafter, serves as a stop to limit movement of stub 32' in both the proximal and distal directions.

The stub 32' includes a barrel portion 62 having a radially extending shoulder 64 which is secured, as by soldering, to the conductor section *22a*. The barrel portion 62 extends from the shoulder 64 in a distal direction for a portion of its length and then is necked inwardly to a decreased diameter portion 63 which extends in a distal direction. A radially extending shoulder 66 separates portions 62 and 63. Shoulder 66 may engage portion 60 on the sleeve 34' to limit movement of the stub in a distal direction whereupon the gap between sleeve and shoulder 64 is decreased sufficient that the dimension X is on the order of zero.

A bushing 70, of enlarged diameter, is secured to a tubular member 72 which extends in a distal direction to a bushing 74. Bushings 70 and 74 are secured to the tubular member 72, as by soldering. The bushing 74 is provided with an axially directed bore 76 for receiving a washer 78 and a bolt having a bolt head 80 and a threaded shaft 82. The threaded shaft 82 extends through a bore in the tubular member 72, and thence through a bore in bushing 70 and is threaded into a threaded bore in the portion 63. This assembly with the bolt is accomplished once the stub has been slidably received by the sleeve 34' so that the stub with its tubular portion extends beyond the sleeve in the manner shown in FIG. 4.

As in the embodiment of FIG. 3, the embodiment of FIG. 4 includes a stub 32' which, at its distal end, is separated by air from the inner surface of conductor section **22*b* providing an RF open circuit of high impedance therebetween. The stub 32' has a total length on the order of one-quarter wavelength and consequently essentially a short circuit is provided at the location between the two sections 22*a* and 22*b*. Consequently, there is very little attenuation of the RF energy at the design frequencies employed. The various parts making up the stub 32' may be constructed of brass which may be silver plated. The insulator sleeve 34'** is constructed of dielectric material, preferably Teflon.

Although the invention has been described in conjunction with preferred embodiments, it is to be appreciated that various modifications may be made without departing from the spirit and scope of the invention as defined by the appended claims.

Having described the invention, the following is claimed:

1. An RF expansion joint for electrically coupling first and second axially spaced tubular conductor sections, having opposing free ends, together as said conductor sections axially expand and contract with temperature variations and for providing passage of RF energy at a desired operating frequency between said sections and comprising:

an elongated insulator sleeve constructed of dielectric material and received throughout most of its length by said first tubular conductor section, said sleeve having a passageway extending longitudinally therethrough and which passageway is coaxial with said first and second conductor sections;

an electrically conductive elongated stub having a proximal end and distal end with said proximal end mounted to the free end of said second tubular section and with said distal end extending toward the free end of said first conductor section;

said elongated stub being longer than that of said passageway and being slidably received by said passageway so that the distal end of said stub extends in a distal direction through and beyond said sleeve sufficient that said distal end is spaced inwardly from the inner walls of said first section presenting essentially an open circuit to passage of said RF energy;

means for limiting the axial movement of said stub along said passageway to a limited distance which is substantially less than the length of said stub to thereby limit the axial expansion and contraction of said sections to said distance;

said distal and proximal ends of said stub are spaced from each other by approximately one-quarter wavelength at said operating frequency; and wherein said means for limiting includes a radially extending flange portion located on the distal end of said stub.

2. An RF expansion joint as set forth in claim 1 wherein said first and second tubular conductor sections are sections of an inner tubular conductor of circular cross section and which are encircled by an elongated rigid tubular outer conductor of circular cross section with said inner and outer conductors defining a coaxial structure.

3. An RF expansion joint as set forth in claim 2 wherein said coaxial structure is an RF broadcasting antenna structure.

4. An RF expansion joint for electrically coupling first and second axially spaced tubular conductor sections, having opposing free ends, together as said conductor sections axially expand and contract with temperature variations and for providing passage of RF energy at a desired operating frequency between said sections and comprising:

an elongated insulator sleeve constructed of dielectric material and received throughout most of its length by said first tubular conductor section, said sleeve having a passageway extending longitudinally therethrough and which passageway is coaxial with said first and second conductor sections;

an electrically conductive elongated stub having a proximal end and distal end with said proximal end mounted to the free end of said second tubular section and with said distal end extending toward the free end of said first conductor section;

said elongated stub being longer than that of said passageway and being slidably received by said passageway so that the distal end of said stub extends in a distal direction through and beyond said sleeve sufficient that said distal end is spaced inwardly from the inner walls of said first section presenting essentially an open circuit to passage of said RF energy;

means for limiting the axial movement of said stub along said passageway to a limited distance which is substantially less than the length of said stub to thereby limit the axial expansion and contraction of said sections to said distance;

said distal and proximal ends of said stub are spaced from each other by approximately one-quarter wavelength at said operating frequency; and wherein said means for limiting includes a radially inwardly extending shoulder portion of said sleeve and an annular groove in said stub for receiving said shoulder portion of said sleeve and a pair of axially spaced apart cooperating radially outwardly extending shoulders on said stub.

5. An RF expansion joint as set forth in claim 4 wherein the first and second tubular conductor sections are sections of an inner tubular conductor of circular cross section and which are encircled by an elongated rigid tubular outer conductor of circular cross section with said inner and outer conductors defining a coaxial structure.

6. An RF expansion joint as set forth in claim 5 wherein said coxial structure is an RF broadcasting antenna structure.

* * * * *